United States Patent [19]

Ball

[11] 4,351,017

[45] Sep. 21, 1982

[54] AMBIENT LIGHT

[75] Inventor: Douglas C. Ball, Quebec, Canada

[73] Assignee: Hauserman Ltd., Waterloo, Canada

[21] Appl. No.: 80,385

[22] Filed: Oct. 1, 1979

[51] Int. Cl.[3] ..... F21S 1/02

[52] U.S. Cl. ..... 362/147; 362/33; 362/220; 362/368

[58] Field of Search ..... 362/147, 33, 220, 368

[56] References Cited

U.S. PATENT DOCUMENTS

| | | | |
|---|---|---|---|
| 3,389,246 | 6/1968 | Shemitz | 362/147 |
| 4,097,918 | 6/1978 | Anderson et al. | 362/147 |

*Primary Examiner*—Stephen J. Lechert, Jr.

*Attorney, Agent, or Firm*—Maky, Renner, Otto & Boisselle

[57] ABSTRACT

A combination space dividing wall panel and elongated, fluorescent lighting fixture wherein the fluorescent lighting fixture is mounted a predetermined distance above the upper edge of the wall panel by a pair of lighting fixture support rods, each having a threaded stud at the bottom of such rod, which is threadingly inserted into the upper part of a metal post attached to and supporting an end of a space dividing wall panel. The support rods rotatably engage spaced, slotted apertures in the underside of the lighting fixture to provide for either linear alignment of the elongated lighting fixture with respect to a space dividing wall panel, or, an angular relationship with respect to interconnected, angularly related wall panels.

10 Claims, 6 Drawing Figures

AMBIENT LIGHT

BACKGROUND OF THE INVENTION

This invention relates to an improved lighting fixture and space dividing, wall panel combination, to subdivide an office area into smaller work spaces and to provide illumination for a desk or table while simultaneously providing light for illuminating the remainder of the work space.

Light fixture and panel combinations in which both direct and indirect illumination are provided, have been described in U.S. Pat. Nos. 3,389,246 and 4,097,918.

The first named patent discloses a lighting fixture mounted directly on the upper edge of a space dividing wall panel, producing a distinct disadvantage in that the height of the lighting fixture above the floor is limited by the height of the upper edge of the space dividing wall panel. Another disadvantage is that the lighting fixture does not include means for reflecting light upwards, toward a ceiling. Because of this, the lighting fixture allows equal quantities of light to be directed downwardly and upwardly. A further problem is that the disclosed lighting fixture is mounted in a fixed position running lengthwise along the top edge of the space dividing wall panel, and is not capable of spanning the space between two angularly disposed space dividing wall panels.

U.S. Pat. No. 4,097,918 reveals a space dividing wall panel and elongated lighting fixture supported at either end by a vertical post with one end fastened to the bottom of the elongated lighting fixture supported at either end by a vertical post with one end fastened to the bottom of the elongated lighting fixture, and the other end terminating in a U-shape saddle member of engaging the upper horizontal edge of a wall panel. The U-shape saddle member is rotatable with respect to the elongated lighting fixture and will engage said upper horizontal edge of the space dividing wall panel at a plurality of points, making it possible for the elongated lighting fixture to span the space between two angularly disposed space dividing wall panels.

A drawback in the space dividing wall and lighting fixture system disclosed by the second patent, is that the U-shape saddle member makes it necessary that the vertical post be of large diameter in order to provide a solid connection between the vertical post and the U-shape saddle member. Furthermore, the U-shape saddle member provides a connection with the space dividing wall panel which is not as rigid as is desirable. The U-shape saddle member can also marr the surface of the space dividing wall panel at the point where the U-shape saddle member engages the upper horizontal wall edge, rendering the system somewhat unsightly after a period of use.

SUMMARY OF THE INVENTION

In view of the foregoing, it is the main object of this invention to provide an elongated, fluorescent lighting fixture, rigidly mounted to vertical, panel support members by lighting fixture support means which position the lighting fixture a distance above the upper edge of a space dividing wall panel.

It is also an object to provide an elongated lighting fixture which may be employed with panels of a plurality of widths.

A further object is to provide an elongated lighting fixture which may be disposed above and spanning the space between, two space dividing wall panels angularly joined at a common vertical panel support member.

These objects are attained by providing in combination, at least on planar, vertically oriented space dividing wall panel having an upper edge portion and an elongated lighting fixture spaced above and overlying at least in part the upper edge portion of the space dividing wall panel or panels. The elongated lighting fixture, in its bottom, includes a pair of spaced, slotted apertures running lengthwise along the elongated lighting fixture, which engage a pair of lighting fixture support means, which include a threaded, shouldered stud rotatably mounted at the upper end of each lighting fixture support means, and which threaded, shouldered stud may be removably secured at any point along one of the slotted apertures. Also included, is a threaded stud at the bottom of each of the lighting fixture support means, which threaded stud rigidly connects with the upper end of a vertical panel support member, which supports and interconnects the ends of one or more space dividing wall panels. The lighting fixture support means may be connected with the non-adjacent panel support members of two angularly associated wall panels, having an angle between them of not more than 180°, to position an elongated lighting fixture above the two wall panels.

BRIEF DESCRIPTION OF THE DRAWINGS

Many of the attendant advantages of the present invention will become more readily apparent and better understood as the following detailed description is considered in connection with the accompanying drawings, in which.

DESCRIPTION OF THE PREFERRED EMBODIMENTS

Figure 1:
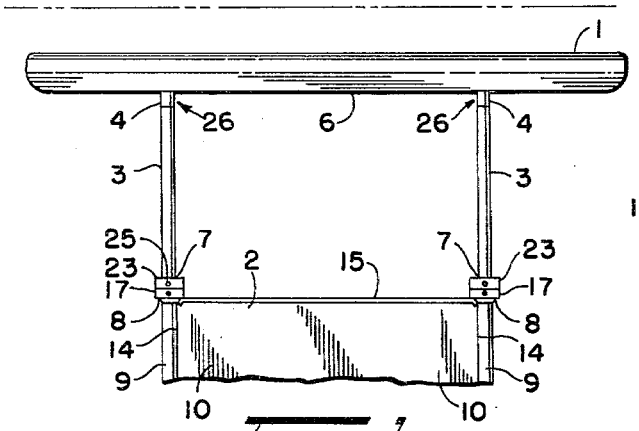
FIG. 1 is a fragmentary, side elevation view of the combination lighting fixture and wall panel of this invention.
Figure 2:
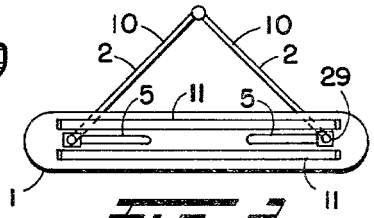
FIGS. 2 and 3 are top plan views illustrating the combination lighting fixture and wall panel of this invention.
Figure 3:
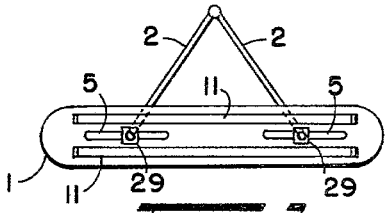

Referring now in detail to the drawings wherein like reference characters represent like parts throughout the several views, there is illustrated in FIGS. 1 through 3, the versatile lighting fixture wall panel combination of this invention. In FIG. 1 an elongated lighting fixture 1 is mounted to a single, vertically oriented, planar wall panel 2 of a space dividing office system by means of a pair of spaced metal rods 3, the tops 4 of which engage with a pair of spaced, slotted apertures 5 along the underside 6 of said elongated lighting fixture, and the bottoms 7 of which rods are rigidly connected with the upper ends 8 of a pair of vertical metal posts 9, each of which supports an end 10 of a space dividing wall panel. Because of the mechanical interconnection between the top 4 of each metal rod 3 and the corresponding, spaced, slotted aperture 5 on the underside 6 of the elongated lighting fixture, the elongated lighting fixture 1 is variably, rotatably positionable about the axis of each of the two metal rods 3 supporting the fixture 1. As best seen in FIGS. 2 and 3, this permits a single, elongated lighting fixture to be associated with more than one panel, and to thereby span a portion of the office space defined by a given set of panels angularly disposed with respect to each other.

Figure 4:
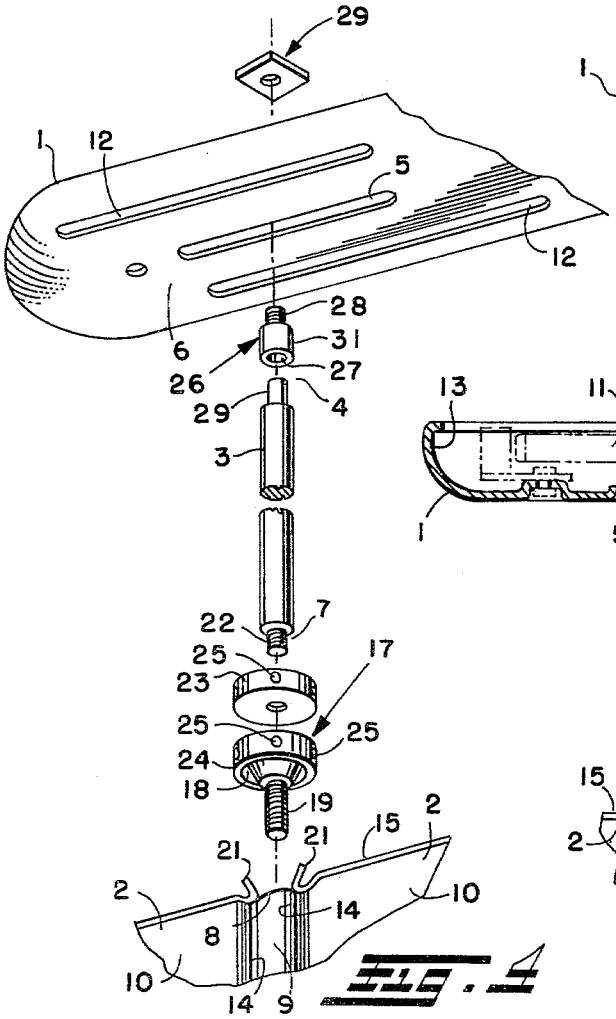
FIG. 4 is a fragmentary, exploded, perspective view of the lighting fixture support means and associated parts of the rest of the combination space dividing wall panel and lighting fixture.
Figure 6:
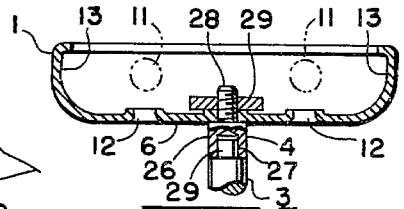
FIG. 6 is a fragmentary, sectional view taken along the line 6—6 of FIG. 5.
Figure 5:
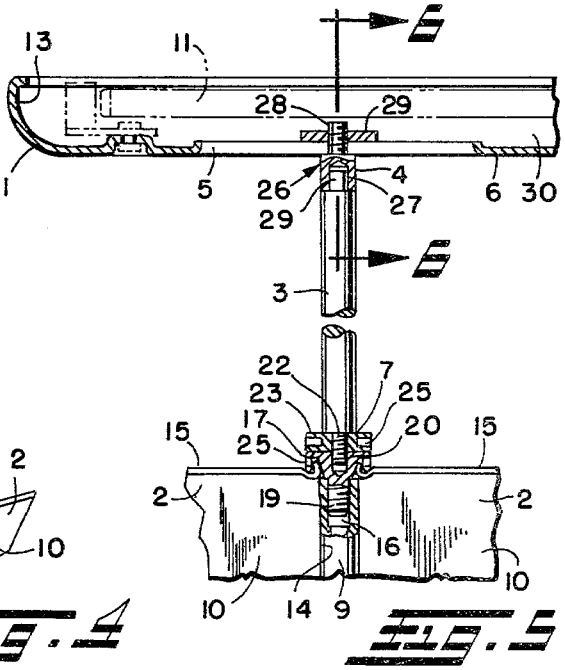
FIG. 5 is a fragmentary, sectional, side elevation view of the space dividing wall panel and lighting fixture combination.

Referring now to FIGS. 4, 5, and 6 wherein a more detailed description of the unique lighting fixture space dividing wall panel combination of this invention is illustrated, the elongated lighting fixture 1 includes a pair of fluorescent lamp tubes 11 which provide downwardly directed task lighting through two parallel rows of elongated apertures 12 and indirect, or, upwardly directed light, by both direct rays and from light reflected from the concave upward inner surfaces 13 of the elongated lighting fixture.

As seen in FIGS. 1 through 5, each vertical metal post 9 may be connected to one or more space dividing wall panels along one of the vertical edge portions 14 of said wall panels 2. Each of the metal posts is roughly of the same height as the upper edge portions 15 of the space dividing wall panels to which it is attached, and each space dividing wall panel is supported in its vertical position by means of a pair of metal posts, with one post secured to each of the two vertical edge portions 15 of the space dividing wall panel. As shown in FIGS. 2 through 5, two space dividing wall panels may be hingedly secured to a single metal post, allowing two space dividing wall panels 2 to be linearly disposed with respect to each other, as in FIGS. 4 and 5, or, allowing two space dividing wall panels to be angularly disposed with respect to each other, as shown in FIGS. 2 and 3.

Each metal post 9 has an upper end connecting means comprised of an axially vertical, threaded socket 16 as shown in FIG. 5, into which a large, threaded bolt 17 may be threadingly inserted. Each large, threaded bolt has an annular depression 18 in the shank side face of the bolt head 24, which annular depression rings the shank 19. A female threaded shaft 20 is provided in the face of the bolt head opposite the shank side face and is coaxial with the threaded shank 19 of the bolt. The annular depression in the bolt head engages an adjacent part 21 of the upper edge portion 15 of each space dividing wall panel 2, to which the metal post 9 is attached, to aid in securing each such space dividing wall panel to the metal post, as shown in FIGS. 4 and 5. The metal rod 3 has lower connecting means comprising a threaded stud 22 which is threadingly inserted through a large nut 23 of roughly equal diameter as the bolt head 24, and is then threadingly inserted into the female threaded shaft 20 in the bolthead, as shown in FIGS. 1 and 5. As shown in FIGS. 1, 4 and 5, the vertical edges of the large nut and the bolt head are cylindrical in shape, and two sets of opposing holes 25 at right angles to each other, are provided in the vertical edges of both the large nut and the bolt head in order that a spanner wrench may be used to first tighten the bolt into the metal post 9, and, then, after the threaded stud 22 has been threadingly inserted through the nut 23 and into the female threaded shaft 20, to tighten the metal rod 3 within the female threaded shaft of the bolt head by tightening the large nut against the face of the bolt head opposite the shank side face.

As shown in FIGS. 4, 5 and 6, each metal rod includes a threaded, shouldered stud 26 to engage the spaced, slotted apertures 5 in the bottom 6 of the elongated lighting fixture, and to rotatingly support the elongated lighting fixture 1 in a position at the top 4 of the metal rod 3. The threaded, shouldered stud includes a mounting socket 27 opposite the threaded portion 28 of the shouldered stud 26, into which an insert 29 at the upper end of the non-threaded-shouldered-stud portion of the metal rod 3, may be inserted. Both the socket 27 and the insert have smooth surfaces allowing the threaded, shouldered stud to be easily rotated about the axis of the inserted insert.

The two, spaced, slotted apertures are co-linear with the centerline running lengthwise along the bottom 6 of the elongated lighting fixture. Each slotted aperture has a width just slightly greater than the crest diameter of the threaded portion 28 of the threaded, shouldered stud, so that the threaded portion of the stud may be snugly inserted through one of the slotted apertures. A female threaded plate 29 may be threadingly engaged with the threaded portion of the stud which has been inserted through a slotted aperture and projects into the interior 30 of the elongated lighting fixture. The female threaded plate may be advanced along such threaded portion of the stud until the shouldered portion 31 of the threaded, shouldered stud, presses against the bottom 6 of the elongated lighting fixture, and, the female threaded plate presses against the inside surface 13 of the elongated lighting fixture to secure the threaded, shouldered stud and inserted metal rod 3, in a fixed position along the slotted aperture. Since the secured, threaded, shouldered stud may be rotated about the axis of the insert, the elongated lighting fixture may be disposed at a plurality of angles with respect to a wall panel 2 over which it is positioned. The female threaded plate may be loosened, allowing the threaded, shouldered stud and inserted metal rod, to be positioned anywhere along the threaded aperture through which the stud is inserted, thereby, allowing the light fixture to be used with space dividing wall panels of varying length, and, to be attached to non-adjacent metal posts 9 associated with two, angularly disposed, space dividing wall panels joined by a common metal post, as shown in FIGS. 2 and 3.

The metal rod 3 may be provided with a groove running along its length to accommodate a conventional electric cord for supplying electrical power to the elongated lighting fixture.

As will be apparent from the foregoing, the combination space dividing wall panel and lighting fixture of this invention provides a versatile lighting system for an open office plan which permits the lighting fixture to be associated with one or more wall panels regardless of the panel width or of the angular orientation between adjacent, interconnected wall panels and permits great versatility with regard to locating the light source where ambient or additional task lighting is needed.

I claim:

1. A space dividing wall panel and lighting fixture combination comprising:

at least one planar, vertically oriented, space dividing wall panel having an upper edge portion and two vertical edge portions, a vertical panel support member bordering, and hingedly secured to each vertical edge portion and including upper end connecting means, an elongated lighting fixture having spaced engaging means on the underside thereof, said fixture being above and overlying at least in part said upper edge portion of said vertical panel support member, a pair of lighting fixture support means, said lighting fixture support means each including lower connecting means at the lower end thereof constructed and arranged to rigidly connect with said upper end connecting means, and, complimentary engaging means at the upper end thereof constructed and arranged to engage with one of said spaced engaging means on the underside of said elongated lighting fixture at any one of a plurality of different positions longitudinally along said elongated lighting fixture.

2. The combination space dividing wall panel and lighting fixture according to claim 1, wherein said at least one planar, vertically oriented, space dividing wall panel comprises a pair of wall panels which are hingedly interconnected by and to a common vertical panel support member, said interconnected wall panels being angularly associated with each other at an angle of not more than 180° and wherein each of said lighting fixture support means is associated with a different one of two of the vertical panel support members supporting said pair of interconnected wall panels, wherein neither of said two of the vertical panel support members is said common vertical panel support member.

3. The combination space dividing wall panel and lighting fixture according to claim 1 or claim 2, wherein said upper end connecting means comprise an axially vertical, threaded socket and wherein said lower connecting means include a threaded stud to threadingly engage said threaded socket.

4. The combination space dividing wall panel and lighting fixture according to claim 3 wherein said spaced engaging means are slotted apertures running lengthwise in the underside of said elongated lighting fixture and said complimentary engaging means include a threaded, shouldered stud axially rotatable with respect to the rest of the lighting fixture support means, and, wherein the threaded portion of said shouldered stud fits through said slotted aperture and wherein the lower, shoulder portion, of said shouldered stud is sufficiently large to prevent the remainder of said shouldered stud and lighting fixture support means from passing through said slotted aperture, and, wherein the threaded portion of the shouldered stud protruding through said slotted aperture is threadingly received by a female threaded plate, in the interior of said elongated lighting fixture.

5. The combination space dividing wall panel and lighting fixture according to claim 4, wherein said slotted apertures are co-linear with the center-line running lengthwise along the bottom of said elongated lighting fixture.

6. The combination space dividing wall panel and lighting fixture according to claim 5, wherein each of said lighting fixture support means comprise a metal rod, and wherein each of said vertical panel support members comprises a metal post.

7. The combination space dividing wall panel and lighting fixture according to claim 6, wherein said threaded, shouldered stud is not integrally formed with said metal rod and which threaded, shouldered stud includes a mounting socket opposite the threaded portion of said threaded, shouldered stud, and wherein said metal rod includes insert means on its upper end, wherein the insert means may be snugly inserted within the mounting socket, whereby the threaded, shouldered stud and said elongated light fixture with which it is engaged, may be supportingly rotated about the axis of the metal rod.

8. The combination space dividing wall panel and lighting fixture according to claim 7, wherein said upper end connecting means comprise, in addition to said axially vertical, threaded socket, a large threaded bolt with an annular depression in the shank-side face of the bolt head, which annular depression rings said shank, a female threaded shaft in the face of the bolt head opposite said shank-side face and coaxial with said threaded shank, and, a locking nut, wherein both said female threaded shaft and said locking nut will threadingly accommodate said threaded stud on said lower end of said metal rod and wherein said threaded stud has sufficient length whereby said large bolt may be threadingly inserted into said axially vertical, threaded socket in said metal post, to aid in securing said wall panels to said metal post by engaging a portion of said wall panels with said annular depression, and, whereby said threaded stud on the lower end of said metal rod may be threadingly inserted through the locking nut and into the female threaded shaft in the bolt head.

9. A combination space dividing wall panel and lighting fixture according to claim 8, wherein said elongated lighting fixture includes fluorescent lighting means and two parallel rows of apertures in the underside of the elongated lighting fixture.

10. A combination space dividing wall panel and lighting fixture according to claim 9, wherein said elongated lighting fixture opens concavely-upward to provide a surface to reflect light upwardly, whereby said upwardly reflected light may strike a ceiling to provide ceiling reflected illumination.

* * * * *